US005200768A

United States Patent [19]

Shibaike et al.

[11] Patent Number: 5,200,768

[45] Date of Patent: * Apr. 6, 1993

[54] INK RECORDING APPARATUS

[75] Inventors: Narito Shibaike, Hirakata; Soichiro Mima, Nishinomiya; Seiko Minamide, Nara, all of Japan

[73] Assignee: Matsushita Electric Industrial Co., Ltd., Osaka, Japan

[ * ] Notice: The portion of the term of this patent subsequent to Dec. 10, 2008 has been disclaimed.

[21] Appl. No.: 610,967

[22] Filed: Nov. 9, 1990

[30] Foreign Application Priority Data

Nov. 9, 1989 [JP] Japan ..... 1-292899

[51] Int. Cl.[5] ..... B41J 2/16; B41J 2/165

[52] U.S. Cl. ..... 346/140 R

[58] Field of Search ..... 346/140 R

[56] References Cited

U.S. PATENT DOCUMENTS

| | | | |
|---|---|---|---|
| 4,199,767 | 4/1980 | Campbell et al. | 346/75 |
| 4,367,479 | 1/1983 | Bower | 346/140 R |
| 4,458,255 | 7/1984 | Giles | 346/140 R |
| 5,072,241 | 12/1991 | Shibaike et al. | 346/140 R |

FOREIGN PATENT DOCUMENTS

| | | | |
|---|---|---|---|
| 417673A2 | 3/1991 | European Pat. Off. . | |
| 0079665 | 4/1986 | Japan | 346/140 R |
| 0242848 | 10/1986 | Japan | 346/140 R |
| 62-101445 | 5/1987 | Japan . | |
| 0156969 | 7/1987 | Japan | 346/140 R |

OTHER PUBLICATIONS

IBM Technical Disclosure Bulletin, vol. 22 No. 3, Aug. 1979, pp. 917–918.

*Primary Examiner*—Benjamin R. Fuller
*Assistant Examiner*—Alrick Bobb
*Attorney, Agent, or Firm*—Wenderoth, Lind & Ponack

[57] ABSTRACT

An ink recording apparatus used with printers or the like is manufactured by semiconductor device manufacturing techniques. One wall of an ink chamber is formed of a single-crystal substrate and an ink jet port is formed by etching the single-crystal substrate. The ink chamber has a pressure-applying unit therein, and the pressure is applied to ink within the ink chamber so that the ink is jetted through the ink jet port. The pressure-applying unit has piezoelectric elements. A shutter and electrodes composed of polycrystalline-silicon film are formed on the single-crystal substrate by film forming in the LPCVD method and patterning through plasma etching. A front wall is formed by coating the shutter and electrodes further with a polycrystalline-silicon film. The shutter is movable between the wall surface of the ink chamber and the front wall, being driven by an electrostatic attracting force produced between voltage-applied electrodes and the shutter. The electrodes are formed at positions corresponding to those where the shutter blocks the ink jet port and releases the same.

12 Claims, 16 Drawing Sheets

INK RECORDING APPARATUS

BACKGROUND OF THE INVENTION (1) Field of the Invention

The present invention relates to an ink recording apparatus for use in printers or the like. It is to be noted that the word 'recording' herein used refers to the fact that any desired patterns of characters, symbols, or the like are written down onto a printed material such as paper with ink jetted out by an apparatus of the present invention.

(2) Description of the Related Art

In conventional ink recording apparatus that are currently used in printers featuring their compactness suitable for office or personal use thereof, two types of ink jet systems described below are mainly employed. One of the types is a piezoelectric type in which the ink is applied by piezoelectric elements within a ink chamber. Another type is a thermal type in which the ink generates bubbles by the utilization of exoergic of heating elements within a ink chamber.

The piezoelectric type controls the diameter of ink droplets well. However, to arrange the piezoelectric elements in which density is so difficult that the ink jet head is forced to become large in size. Accordingly, it is impossible for an ink jet head to discharge many ink droplets simultaneously. Then, the ink jet head is required to move for recording many dots. The result is that the ink jet head takes a long time to record a predetermined size image from the overall point of view of the recording speed, even if the frequency of ink droplet discharge can be increased within a feasible range. And also, a moving mechanism for the ink jet head is required, which prevents the ink recording apparatus from increasing its compact and lightweight performance, it quiet performance and decreasing demanded power and cost.

On the other hand, the recording speed of thermal type can be increased enough, because a line head can be manufactured easily by substantially integrating the heating elements. However, it needs an independent ink chamber and a nozzle for each heating element. The thermal type ink recording apparatus having such a structure requires a high work precision in the manufacture thereof. The work precision and positional precision between a substrate provided with the thermal elements and the ink chambers have an effect on the ink jet amount so that, not only the control of the ink droplet diameter, but also the manufacturing of the head becomes difficult resulting in a higher cost. Moreover, since the integrating yield of heating elements does not reach the practical level, its cost actually becomes enormous.

A conventional ink recording apparatus is shown in the Japanese magazine "Nikkei Mechanical", issued on May 29, 1989, pp. 90 to 91, the apparatus exemplifying such ink recording apparatus that solve such problems as described above.

FIG. 14 shows a construction of such a conventional ink recording apparatus. In the figure, a slit plate 1 is provided with a plurality of slits 2 having a width of 50 μm and a length of 8 mm in place of nozzles. The slit plate 1 has also a plurality of auxiliary holes 3 equal in number to a plurality of heating elements 5 formed on a base plate 4, with an ink reservoir 6 as well provided on the slit plate. On the base plate 4 there are formed a plurality of electrodes 7 in correspondence with the heating elements 5 and, moreover, a plurality of fluid resistance elements 8 shaped into long, narrow protrusions. Between the slit plate 1 and the base plate 4 there is disposed a spacer 9, which in conjunction with the slit plate 1 and the base plate 4 defines a portion serving as an ink chamber 11 illustrated in FIGS. 15*a* to 15*d*. Under the base plate 4 there is provided an ink tank 10, whereon all the units are piled up to make up a head. The heating elements 5 are formed by piling up a glass layer, resistors, electrodes, and a protective coat on the base plate 4, as in a common thermal head.

A conventional ink recording apparatus having a construction as described above will jet ink droplets while taking the steps as shown in FIGS. 15*a* to 15*d*. Each step is detailed below:

(a) First, when a pulse voltage is applied to the heating elements 5 on the base plate 4 to heat the ink contained in the ink chamber 11, the ink in the vicinity of the heating elements 5 vaporizes to make a large number of small bubbles 12;

(b) Second, the small bubbles 12 merge together and grow into a larger bubble 13 that overcome the surface tension, causing ink swells to be produced at the slits 2;

(c) Third, when the heating elements 5, on completion of heating, are cooled down to stop the bubble 13 from being produced, the swelling of ink is intercepted to produce ink droplets 14; and (d) Finally, the ink droplets 14 are jetted out through the slits 2 by the power of growing bubble 13.

If a number of heating elements 5 share the slits 2 and the ink chamber 11 with one another as in the above conventional apparatus, there arises a problem that the ink droplets 14 derived from adjoining heating elements 5 may interfere with each other. In the conventional apparatus, however, the fluid resistance elements 8 provided between adjoining heating elements 5, as shown in FIG. 14, will serve to prevent pressure waves from being horizontally propagated while the bubbles are being produced, thereby allowing the ink droplets 14 to be formed and jetted out without being adversely affected by such pressure waves. Furthermore, the auxiliary holes 3 provided in the slit plate 1 will absorb the pressure waves, so that pressure waves may be prevented also from being reflected.

In the conventional apparatus arranged as described above, however, the heating elements 5 must eventually be used up in the apparatus, which does not lead the cost of the ink jet head toward any substantial reduction. And since the heating elements 5 need cooling, the recording speed is not increased substantially. Further, during the alternation between heating and cooling under the condition in which the heating elements 5 are wetted with ink, the burnt ink is caused to adhere to the surface of the heating elements 5. The growth of the burnt ink gradually changes the initial ink jet performance, and an inferior recording finally occurs. When the adhesion of burnt ink, in which a coloring matter like an organic dye and thermally decomposed carbon of different types of additives are mainly included, progresses on the surfaces of the heating elements 5, not only the bubbles 12 are generated inhomogeneously, but also the heating elements 5 are thermomechanically fatigued and finally destroyed. Moreover, when the burnt ink is suspended in the ink, it will stop up the slits 2, preventing the ink droplets 14 from being jetted out therethrough.

With respect to the ink properties, in order for the ink to generate the pressure and transmit the pressure to the slits 2, the ink is preferably of a type easy to evaporate and also low enough in viscosity to transmit the pressure consistently with minimal pressure loss. On the other hand, in order for the ink droplets 14 jetted through the slits 2 to fix on the recording paper (not shown), the ink is preferably of a type hard to dry to avoid any possible clogging in the slits 2 and high enough in viscosity to stabilize the jet of ink travelling toward the recording paper and also to avoid any possible running of ink. Particularly, a cheap recording paper generally has a rough surface, since the running of ink can be remarkable on such a surface, the ink is required to have a high viscosity and fixability to allow free selection of recording paper. Thus, the ink is required to have two properties which conflict with each other. It is impossible to design an ink that satisfies the two conflicting requirements. Accordingly, the ink recording apparatus of the prior art is forced to sacrifice at least one of the three performance elements, that is, the lifetime of the heating elements 5, the generating sensitivity of the bubbles 12 and the recording quality. Further, the apparatus needs its own recording paper on which the ink is hard to run. These factors increase not only initial cost but also running cost of the apparatus.

SUMMARY OF THE INVENTION

The present invention has been accomplished to effectively solve the above-mentioned technical problems and, accordingly, an essential object of the present invention is to provide an ink recording apparatus which is low in cost, compact in size, light in weight, quiet in the operation thereof, superior in durability, superior in recording quality without running of the ink, free to select the type of recording paper, able to design the best type of ink for the apparatus, and of high reliability.

In accomplishing these and other objects, according to one preferred embodiment of the present invention, there are provided an ink chamber for reserving ink, an ink jet port provided in the ink chamber, a pressure-applying means for applying pressure to the ink in the ink chamber, a shutter provided at the ink jet port, the shutter being movable between a shut-off position for preventing ink from being jetted out after passing through the ink jet port and a passing position for allowing ink to be jetted through, and a shutter driving means for driving the shutter in response to recording signals the shutter comprises a thin film. The shutter driving means driving the thin film of the shutter comprises electrodes that are provided in correspondence with the shut-off position and the passing position of the shutter. A power supply is also provided for applying a voltage to the electrodes, and a control circuit controls the application of voltage to the electrodes by the power supply. The shutter is thus driven by the electrostatic attraction forces between the surfaces of the electrodes and the surfaces of the shutter.

With the above-mentioned arrangement of the ink recording apparatus according to the first embodiment of the invention, the shutter disposed in the vicinity of the ink jet port make it possible to record dots under the mechanical control of the shutters' movement between the shut-off position and the passing position thereof. Thus the ink recording apparatus according to the invention is lighter in weight, more compact in scale and lower in cost than the conventional ink recording apparatus of the piezoelectric type or thermal type, and, moreover, able to perform a high-density recording with high reliability and superiority in recording quality. Further, the ink recording apparatus according to the invention makes it possible for the ink to be designed most suitably for the apparatus.

According to another preferred embodiment of the present invention, there are provided an ink chamber for reserving ink, an ink jet port provided for the ink chamber, a pressure-applying means for applying pressure to the ink in the ink chamber, a shutter provided in the vicinity of the ink jet port and outside of the ink chamber, the shutter being movable between a shut-off position for preventing ink from being jetted out after passing through the ink jet port and a passing position for allowing ink to pass through, a shutter driving means for driving the shutter responding to recording signals, and a wall provided outside of the shutter for covering an external surface of the shutter the shutter comprises a thin film. The shutter driving means driving the thin film of the shutter comprises electrodes that are provided in correspondence with the shut-off position and the passing position of the shutter. A power supply is also provided for applying a voltage to the electrodes, and a control circuit controls the application of voltage to the electrodes by the power supply. The shutter is thus driven by the electrostatic attraction forces between the surfaces of the electrodes and the surfaces of the shutter.

With the above-mentioned arrangement of the second embodiment of the ink recording apparatus according to the invention, the following operational effects can be obtained in addition to those of the ink recording apparatus of the first embodiment. That is, even if the shutter is subject to ink pressure in its shut-off position, the wall disposed on the rear side thereof supports the shutter to prevent the shutter from being deformed. The wall also prevents the internal structure of the apparatus including the shutter from being touched by hands, fingers, or other external foreign matters, thus enhancing the reliability of the apparatus more than the first embodiment of the invention.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
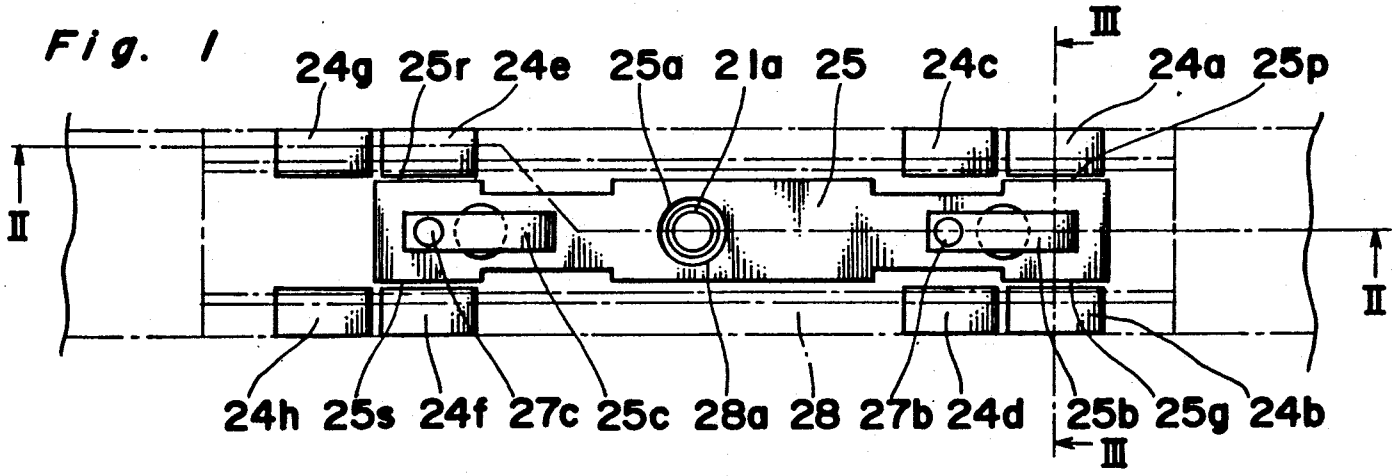
FIG. 1 is a plan view showing the main construction of an ink recording apparatus of a first embodiment according to the present invention.

Before the description of the present invention proceeds, it is to be noted that like parts are designated by like reference numerals throughout the accompanying drawings.

Figure 3:
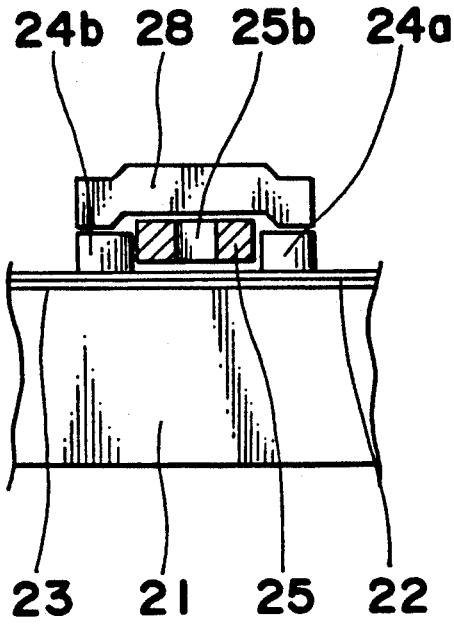
FIG. 3 is a sectional view taken along line III—III of FIG. 1.
Figure 10:
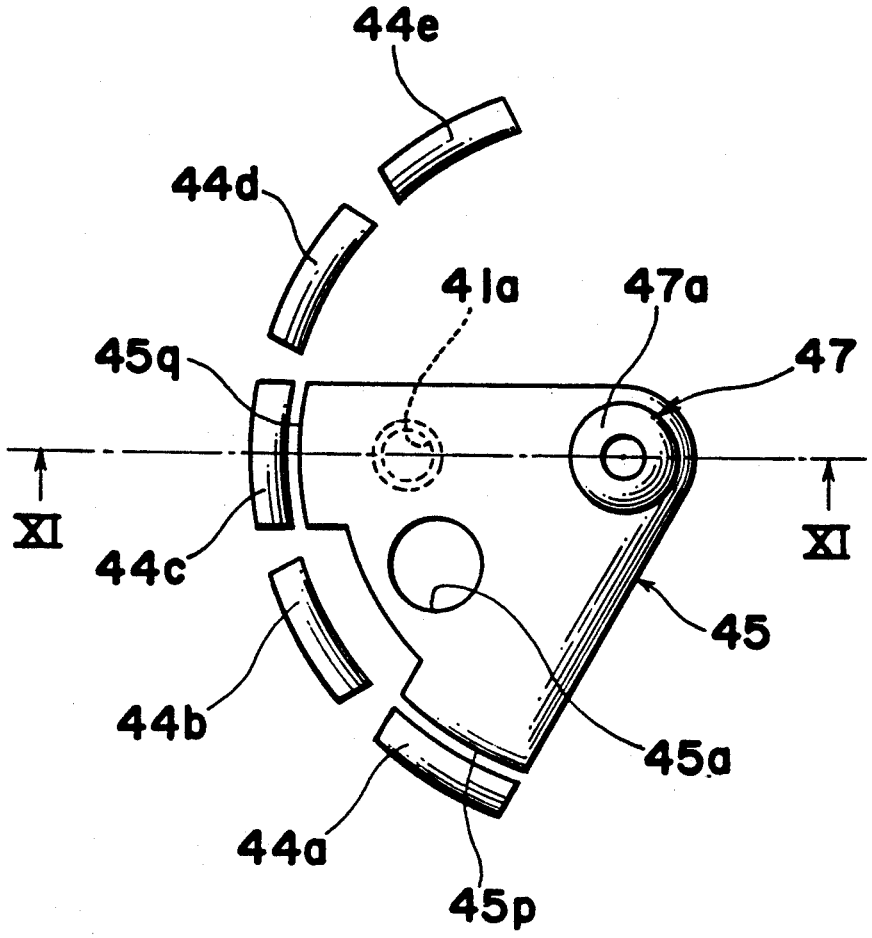
FIG. 10 is a plan view showing the main construction of a second embodiment of the present invention.

Referring first to FIGS. 1 and 3, a single-crystal silicon substrate 21 has an ink jet port 21*a* provided in the center thereof and an ink sump 21*b* provided on its side adjoining an ink chamber 20. The ink jet port 21*a* is formed as bored from the ink sump 21*b* through an oxide film 22 and a nitride film 23. Electrodes 24*a* to 24*h* formed of polycrystalline-silicon, the wiring of which is omitted in the figures, each have on their surfaces a nitride film formed as an insulating layer (not shown). A shutter 25 formed of polycrystalline-silicon has an ink passing hole 25*a* provided in its center and guide slots 25*b* and 25*c* provided on opposite sides thereof. On the surfaces of the shutter 25, except the underside thereof, there are formed nitride films (not shown) as lubricating layers. Guide pins 27*b* and 27*c* are also formed of polycrystalline-silicon. A front wall 28, illustrated by single dotted chain lines in FIG. 1, is integrated with the guide pins 27*b* and 27*c*, has an opening 28*a* provided in its center and ink recovering grooves 28*b* and 28*c* in both its ends. On the other hand, the ink chamber 20 and the ink sump 21*b* are charged with ink 31 composed of insulating material. The ink 31 is subject to working pressures corresponding to recording signals through ordinary means such as a pressure device comprising a piezoelectric element or a heating element as shown in FIG. 10, which means is not shown.

The component parts shown in FIGS. 1 to 3, as detailed later, are integrally manufactured onto the substrate 21 using semiconductor device manufacturing processes including lithography and etching. The result is that the component parts are substantially compact in size, light in weight, and of high precision, comparable to semiconductor products. Therefore, an ink jet head in which the ink recording apparatuses of the present embodiment are integrated is manufactured without difficulty, and it is possible to select the arrangement pattern of the apparatus and/or their arrangement density in integration.

Figure 2:
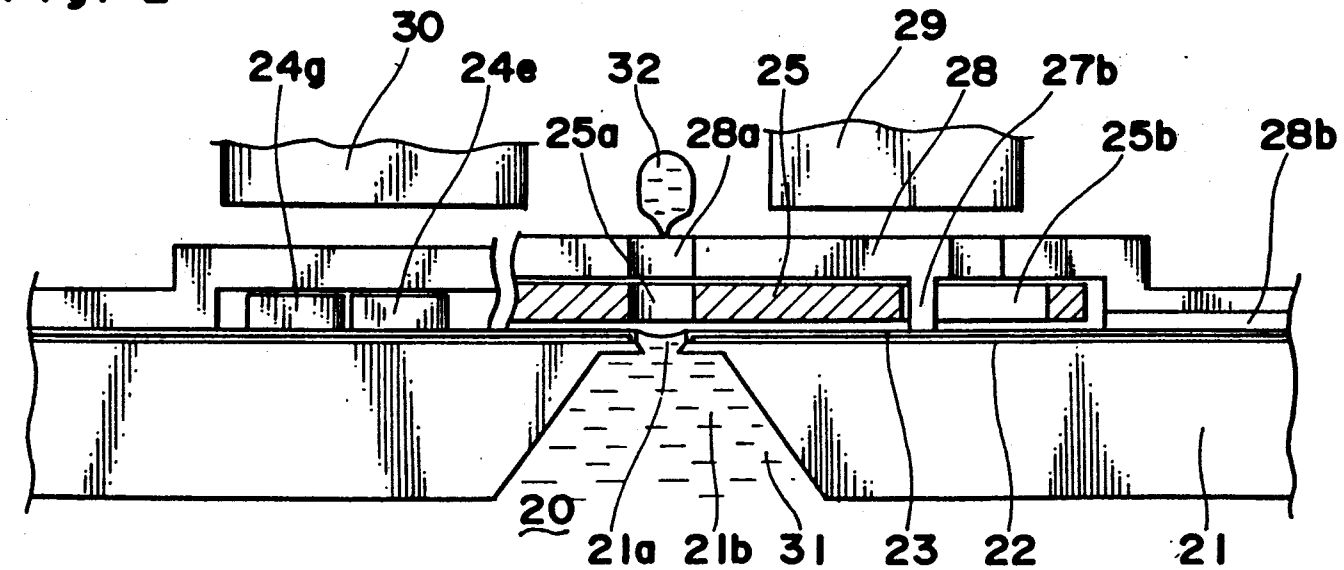
FIG. 2 is a sectional view taken along line II—II of FIG. 1.

Protection plates 29 and 30 shown in FIG. 2 may be manufactured by different method.

Figure 4:
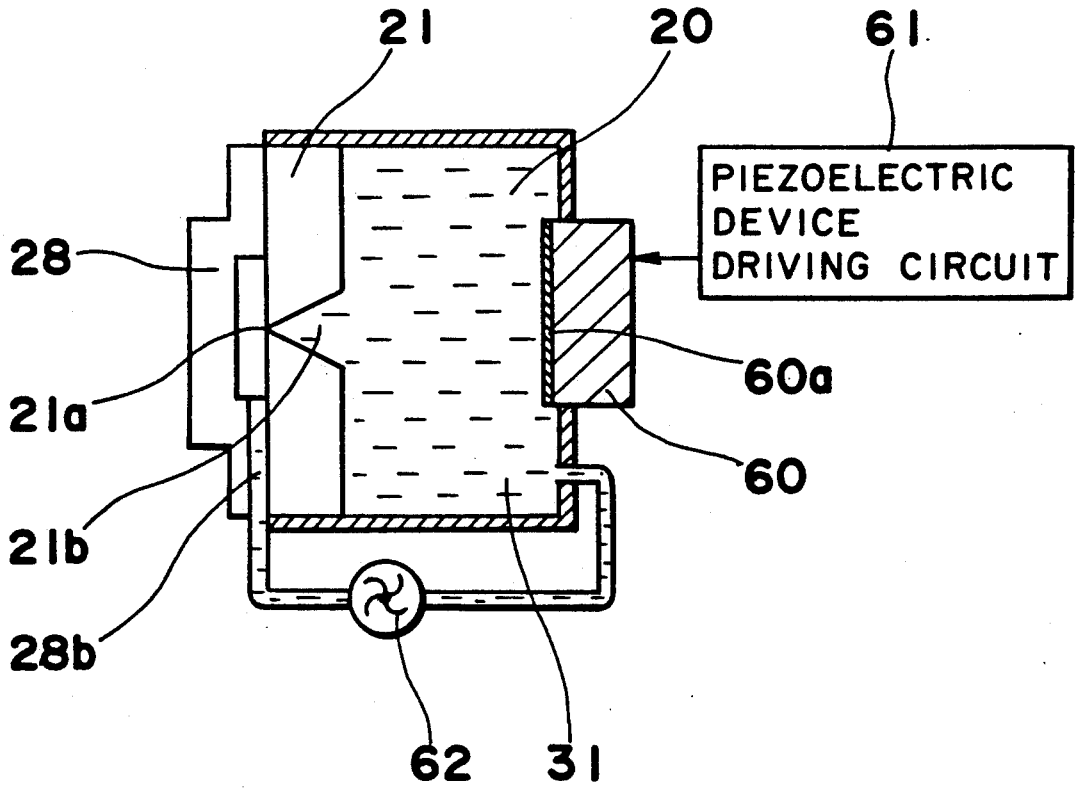
FIG. 4 is a schematic diagram showing a peripheral structure of the ink recording apparatus of FIG. 1.

The ink 31 has pressure applied by a pressure-applying unit 60 comprised of a piezoelectric device 60*a* which is driven by a piezoelectric device driving circuit 61 as shown in FIG. 4. The driving circuit 61 can drive the piezoelectric device 60*a* continuously, or intermittently, or at any timing desired so that the ink has pressure applied simultaneously. On an extension of the ink recovering groove 28*b* extending in the front wall 28 is arranged a pump 62 for recovering ink. The ink is recovered through the groove 28*b* into the ink chamber 20 by the pump 62. With respect to the groove 28*c*, the ink is recovered in the same manner, although not shown.

Figure 5:
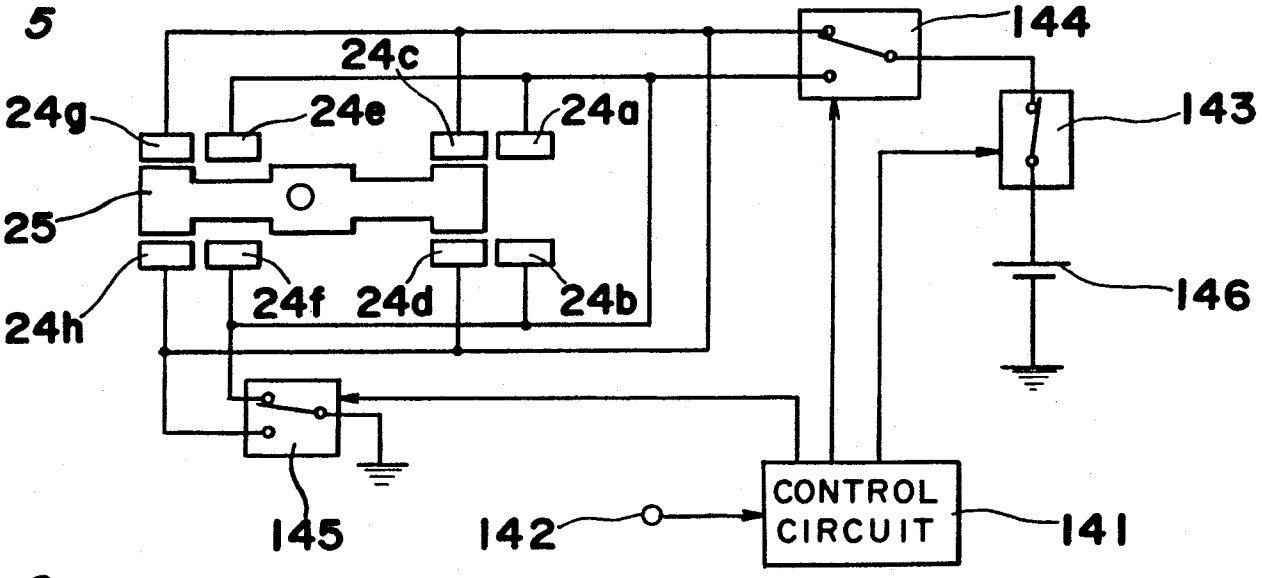
FIG. 5 is a block diagram showing a driving circuit of the ink recording apparatus of FIG. 1.

FIG. 5 is a block diagram showing a driving circuit for driving the shutter 25 of the ink recording apparatus here mentioned. In the figure, a control circuit 141 receives a recording signal from the apparatus main body (not shown) via an input terminal 142, subsequently deciding the status of the signal to control switches 143 to 145. The switch 143 serves to turn on and off a power supply 146, while the switches 144 and 145 serve to control one group of connected electrodes 24*a*, 24*b*, 24*e*, and 24*f* and the other group of like electrodes 24*c*, 24*d*, 24*g*, and 24*h*, respectively, so as to render the two groups of electrodes oppositely phased. More specifically, while a voltage is applied to the side of the electrodes 24*a*, 24*b*, 24*e*, and 24*f*, the electrodes 24*c*, 24d, 24g, and 24h are grounded, and vice versa.

Now the ink recording apparatus arranged as stated above will be explained with respect to its operation. The state thereof shown in FIGS. 1 to 3 is such that the control circuit 141 judges the apparatus to be in ink-jetting operation according to an input signal delivered from the apparatus main body via the input terminal 142, turning on the switch 143 and activating the switches 144 and 145, with the result that a voltage of several times 10 V or so is applied to the side of the electrodes 24*a*, 24*b*, 24*e*, and 24f. In this state, the shutter 25 is stably positioned as shown in the figures with its end 25*p*, 25*q*, 25*r*, and 25*s* moved by virtue of an electrostatic attracting force acting between the ends and the surfaces of the electrodes 24*a*, 24*b*, 24*e*, and 24f, wherein the ink passing hole 25*a* of the shutter 25 is aligned with the ink jet port 21*a*. Then, due to the pressure created within the ink chamber 20 by the pressure-applying unit 60, the ink 31 charged in the ink sump 21*b* passes through the ink jet port 21*a* and ink passing hole 25*a* of the shutter 25 and further through the opening 28*a* of the front wall 28, thus making ink droplets 32 to be jetted out.

At this point of the state of the apparatus, setting recording paper at the outside of the protection plates 29 and 30 allows the ink droplets 32 to record any patterns of characters, symbols, and the like. Moreover, the protection plates 29 and 30 surrounding the shutter 25 for coverage serves to prevent operator's hands or fingers and the like from externally touching the shutter and foreign matter from entering the internal structure including the shutter 25.

After the above-mentioned state, even if the control circuit 141 turns off the switch 143 to de-energize the electrodes 24*a*, 24*b*, 24*e*, and 24f, the shutter 25 will remain stable in rest in the same position thereof, primarily by virtue of surface force.

Figure 6:
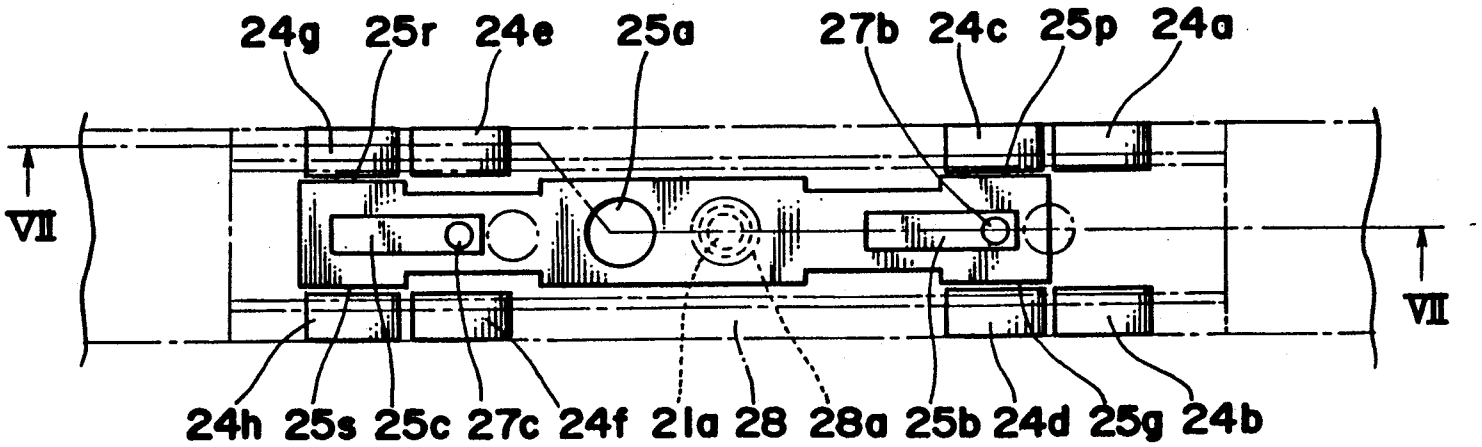
FIG. 6 is a view illustrating the operation of the ink recording apparatus of FIG. 1.
Figure 7:
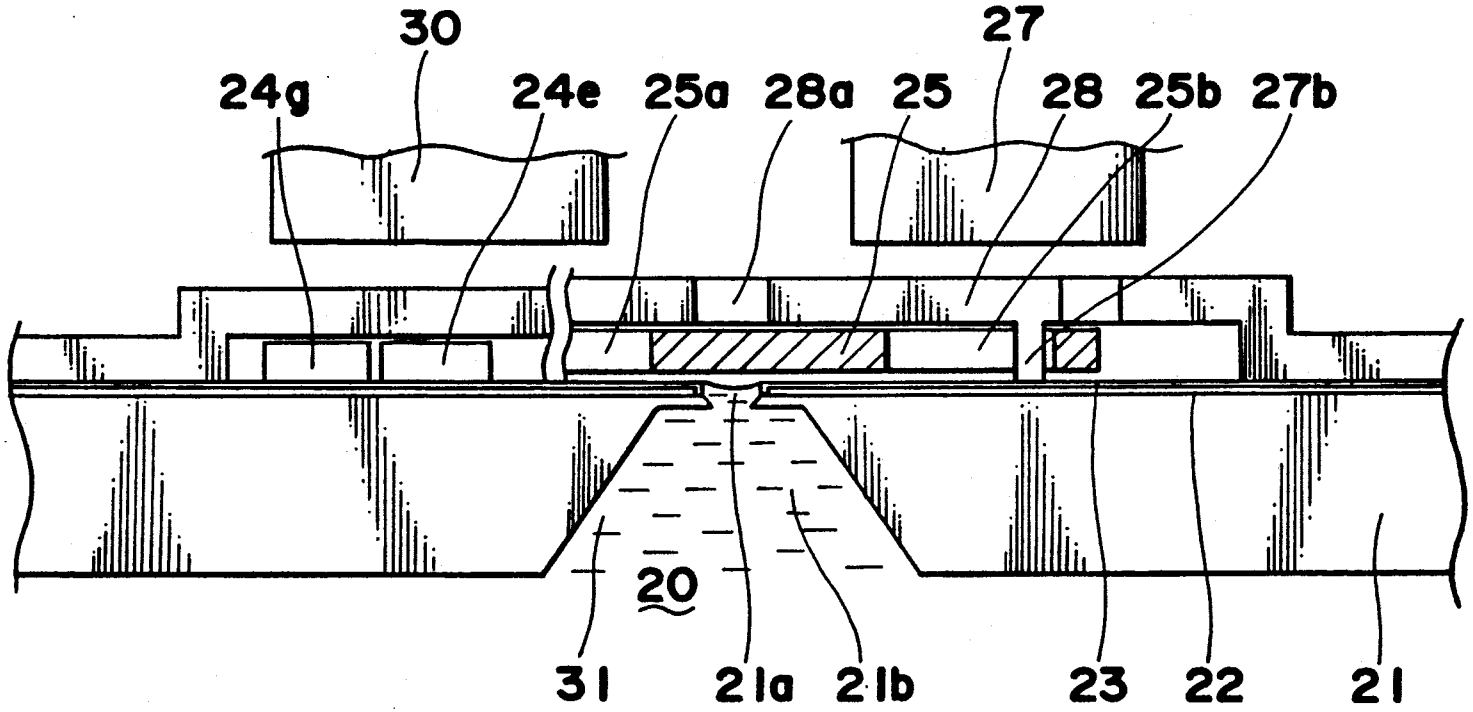
FIG. 7 is a sectional view taken along line VII—VII of FIG. 6.

Next, with reference to FIGS. 6 and 7, the ink recording apparatus will be described in its states in which the shutter 25 has moved away from the position shown in FIG. 1. In this case, the control circuit 141 judges that the apparatus has completed the ink-jetting operation according to an input signal delivered from the apparatus main body via the input terminal 142, changing the condition of the switches 144 and 145, with a result such that a voltage is applied to the side of the electrodes 24*c*, 24*d*, 24*g*, and 24*h*. In this case as shown in FIG. 56, the shutter 25 is stably positioned in rest, having moved from the position shown in FIG. 1 with its ends 25*p*, 25*q*, 25*r*, and 25*s* moved by virtue of electrostatic attracting forcer acting between the ends and the surfaces of the electrodes 24c, 24d, 24g, and 24h. The ink jet port 21a of the substrate 21 is shut off by the shutter 25, so that the ink can not be jetted out through the ink passing hole 254a and opening 258a even if the ink has pressure applied by the pressure-applying unit 60. At this point of state of the apparatus, even if a sheet of recording paper is set at the outside of the protection plates 29 and 30, the shutter 25 does not allow the ink droplets 32 to record any patterns of characters, symbols, or the like.

After the above-mentioned state, even if the control circuit 141 turns off the switch 143 to de-energize the electrodes 24c, 24d, 24g, and 24h, the shutter 25 will remain stable, in rest at the same position thereof, primarily by virtue of surface force. The apparatus therefore, even if left unused for a long period, can prevent any recording failure or any head damage. Moreover, the protection plates 29 and 30 surrounding the shutter 25 for coverage serves to prevent operator's hands or fingers or other foreign matters from externally touching the shutter so that the shutter 25 is not moved thereby.

Much of the ink shut off is backed into the ink sump 21b. The rest of the ink is recovered into the ink chamber 20 through the rear side of the shutter 25, the grooves 28b and 28c and pump 62, and accumulated into the ink sump 21b.

When the shutter 25 shuts the ink jet port 21a, the shutter has a pressure applied by the ink through the port 21a, and is supported by the front wall 28 in the manner that the shutter is pushed against the front wall 28. Therefore, the shutter 25 is not distorted and always keeps itself stable in its performance. That is, after shifting the shutter 25 from the state described above to the state shown in FIGS. 1 to 3, to reset the shutter 25 rapidly to the state shown in FIGS. 6 and 7 makes it possible to record a minimum recording unit called a dot under the condition that the ink 31 is continuously applied pressure by the pressure-applying unit 60. Then, controlling the rest time of the shutter 254 at each of its reset positions, the apparatus can record dots in various manners. In this case, the control circuit 141 shown in FIG. 5 has a function of imaging time, and it is very easy to make up such a circuit.

In this embodiment, however, the shutter 25 has two rest positions. If the number of electrodes 24a to 24h is increased, the number of rest positions is also increased. For example, the shutter may have three rest positions so that the ink passing hole of the shutter allows ink to be jetted only at the center rest position. When the shutter is driven and shifts its position in one direction from one end to another end, a dot is recorded without the returning of the shutter, and the recording speed of such an apparatus becomes faster than that of the embodiment shown in FIG. 1. In this case, the rest time of the shutter may be also controlled as described above.

Further, it is possible to constitute a shutter which allows ink-jetting during its one-direction shifting between two rest positions. In this case, it is difficult for the shutter to stop at the position where the ink is jetted through the ink passing hole.

For example, an ink-jetting mode may be set such that the ink is continuously jetted without being cut into droplets corresponding to each one dot respectively. In such a case, the shutter is required to stop at the position where the ink passes through the ink passing hole of the shutter. Consequently, the recording quality of the apparatus will be somewhat inferior.

To summarize the various embodiments mentioned above, the embodiment shown in FIG. 1 has no problem when the shutter 25 reciprocates at a high enough speed. Comparing the embodiment with another embodiment having three rest positions with respect to the number of electrodes, the number of wires and the integration efficiency, both of them are substantially equal.

Moreover, when the pressure-applying unit 60 can be operated in synchronization with the recording frequency, the ink 31 will not be jetted through the ink passing hole 25a during the movement of the shutter 25. The piezoelectric device is employed in the present embodiment, but other means can be employed as a pressure-creating means instead of this device.

The friction produced between the surfaces of shutter 25 and substrate 21 or front wall 28 acts as a factor for preventing the shutter 25 from sliding. Although, since the nitride film 23 and the like reduce the friction, the shutter 25 is slideable, and a few problems may still remain. However, when the pressure-applying unit 60 is controlled so that the ink 31 is applied pressure in synchronization with the reciprocating of the shutter 25 and the ink droplets are jetted at only the timing in which the ink passing hole 25a of the shutter 25 is aligned with the ink jet port 121a of the substrate 21, which problems of friction are considerably solved, since the shutter 25 is not pushed against the front wall 28. but, in this case, each time the shutter 25 shuts off the ink jet port 11a from ink-jetting, the ink has an impact on the shutter 25 and the front wall 28. For the mechanical strength of the shutter 25 and the front wall 28, it is preferred to have a continuous pressure applied rather than intermittent pressure. Further, the driving circuit 61 will become complicated, and also the power supply and the like will become large sized for creating the intermittent pressure. From a general point of view, both of them are substantially equal.

According to the present embodiment, as described above, it is easy to vary the rest time of the shutter 25 at its rest position where the ink droplets are allowed to be jetted. That is, the size of a dot is controllable by varying the size (volume) of an ink droplet. Therefore, an area graduation recording can be performed, which especially is very useful for recording a picture image, with the recording quality substantially improved. That means an improvement of roughness with respect to image quality, which is very valuable.

As described heretofore, according to the present invention, it is possible to provide an ink recoding apparatus which makes it possible for ink to be most suitably used, because the ink is jetted and shut under the mechanical control of the shutter 25 which is shifted by applying voltages to the electrodes 24a to 24h, and which can be highly reliable and superior to recording quality.

Figure 8A:
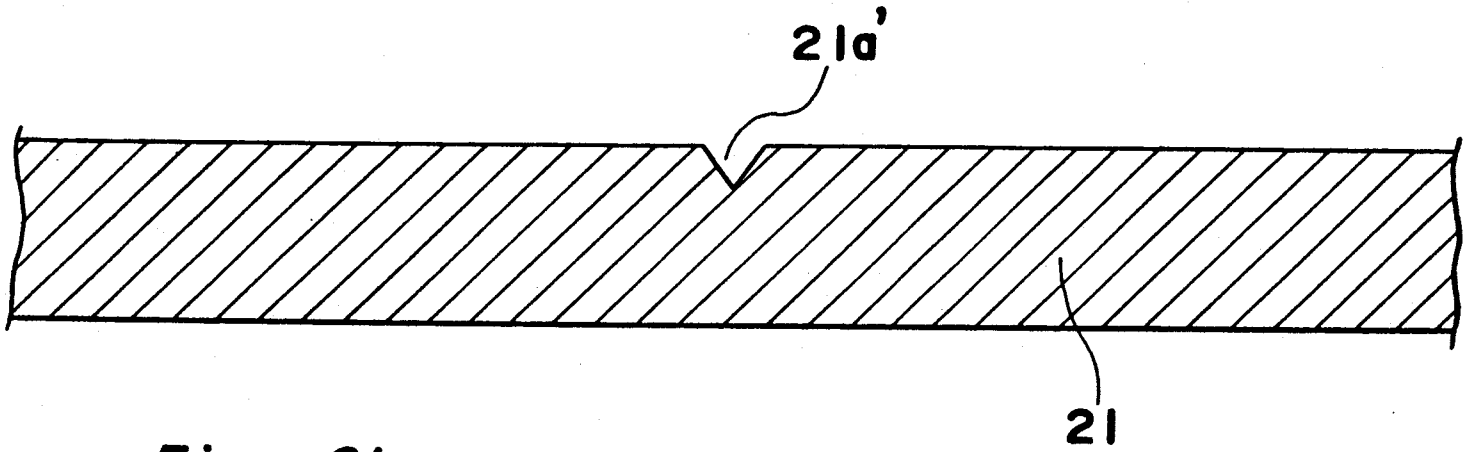
FIGS. 8*a* to 8*n* are views illustrating the manufacture processes of the ink recording apparatus of FIG. 1.
Figure 8B:
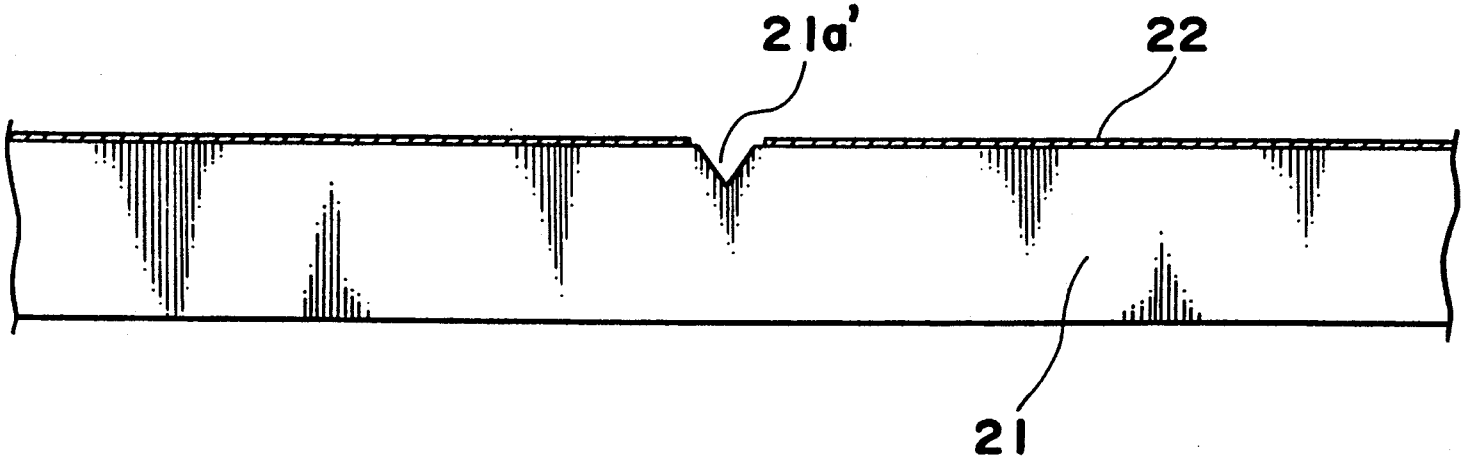
Figure 8C:
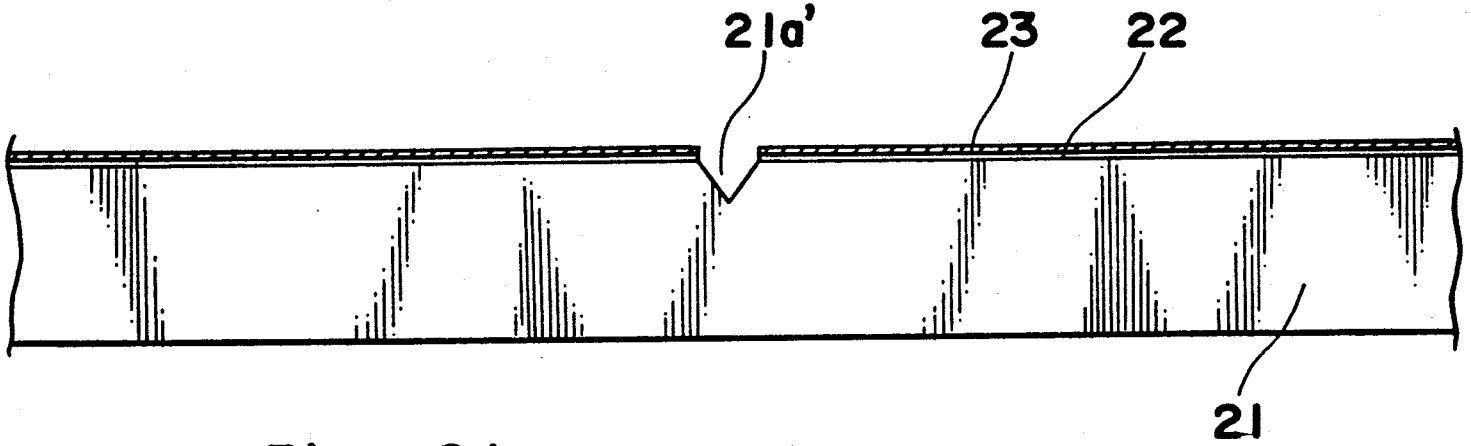
Figure 8D:
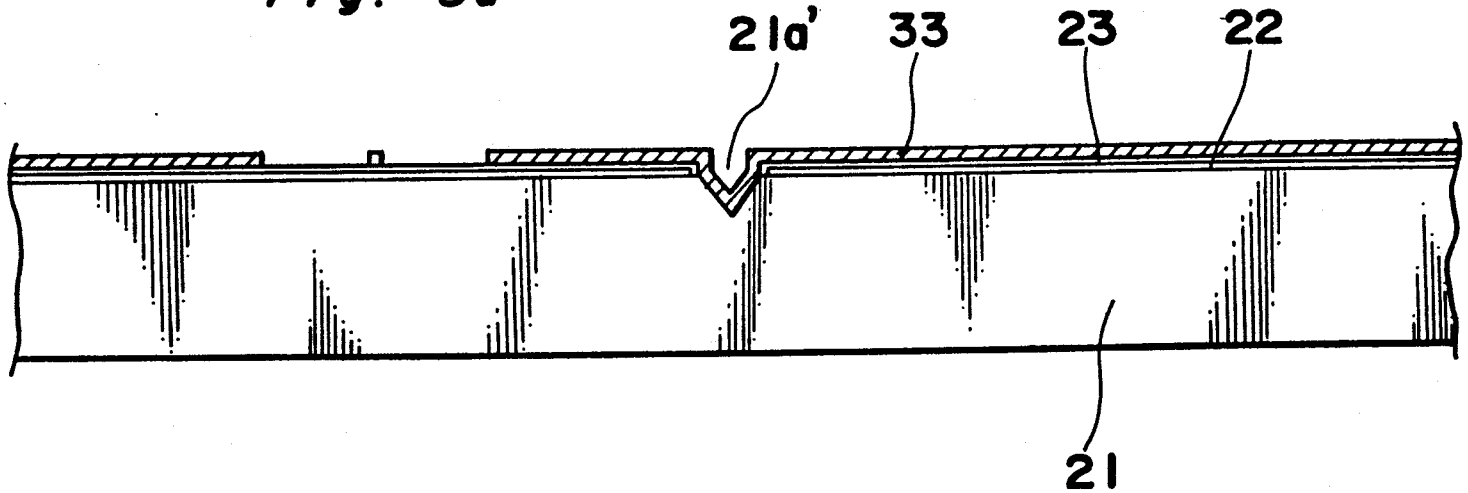
Figure 8E:
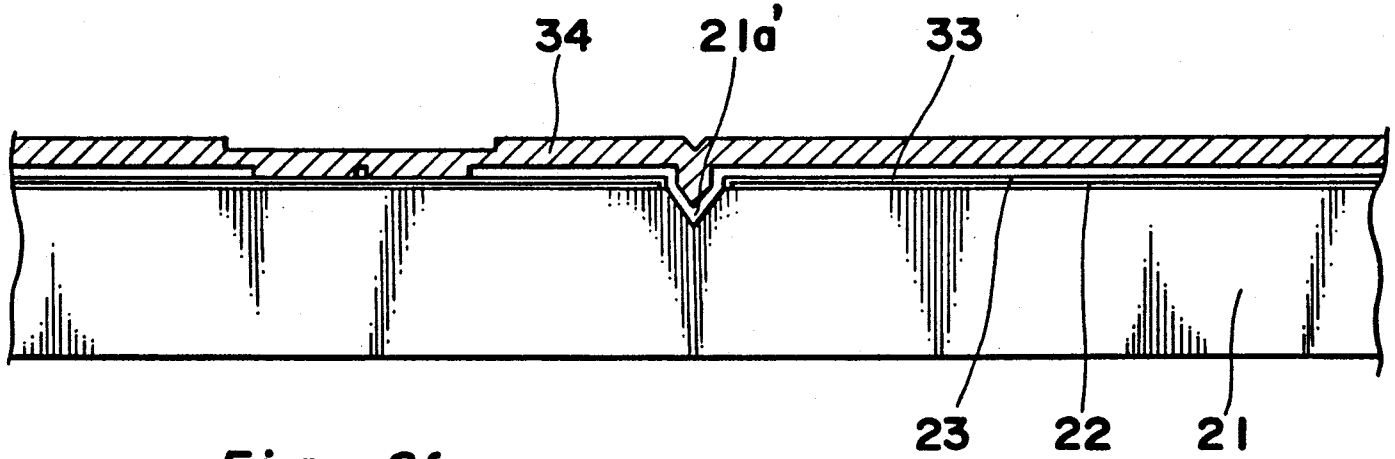
Figure 8F:
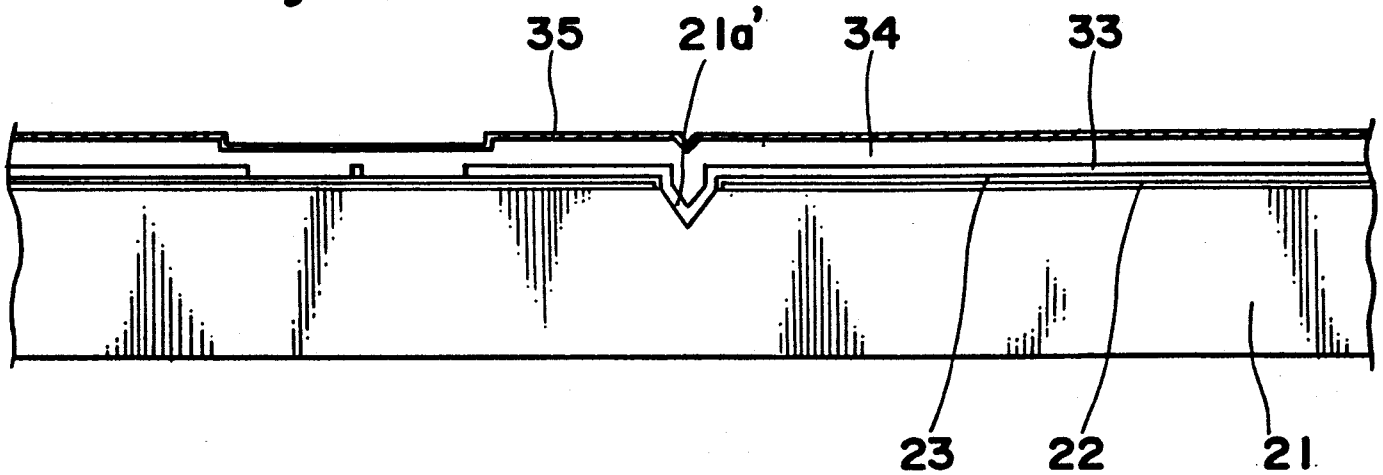
Figure 8G:
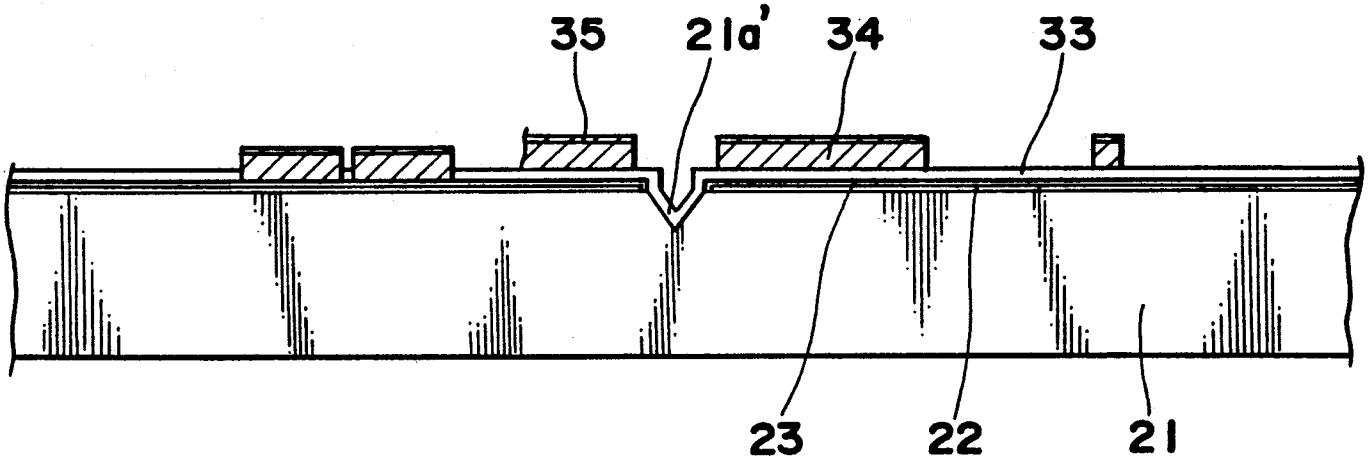
Figure 8H:
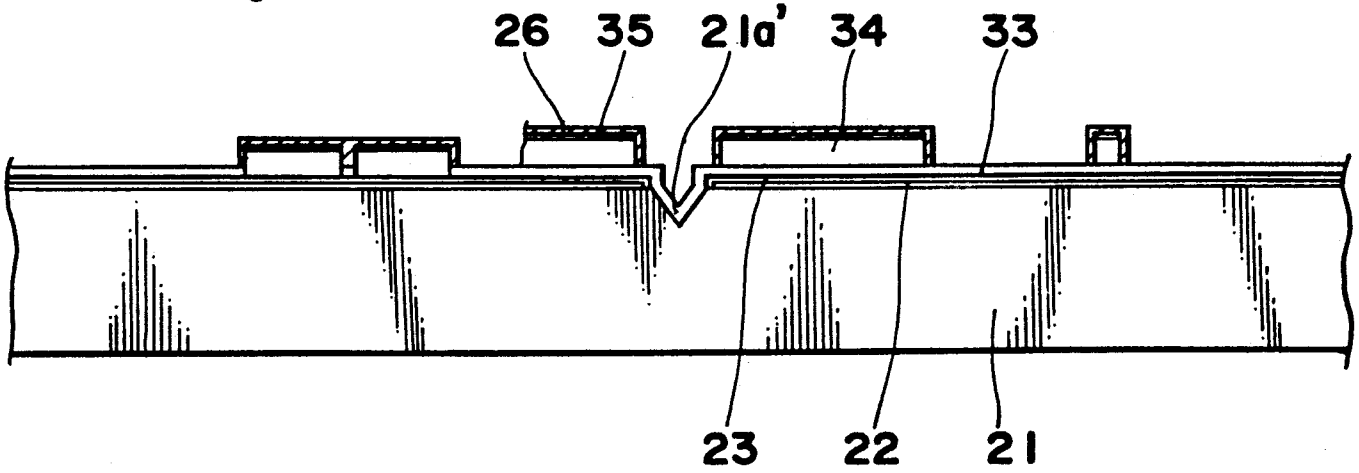
Figure 8I:
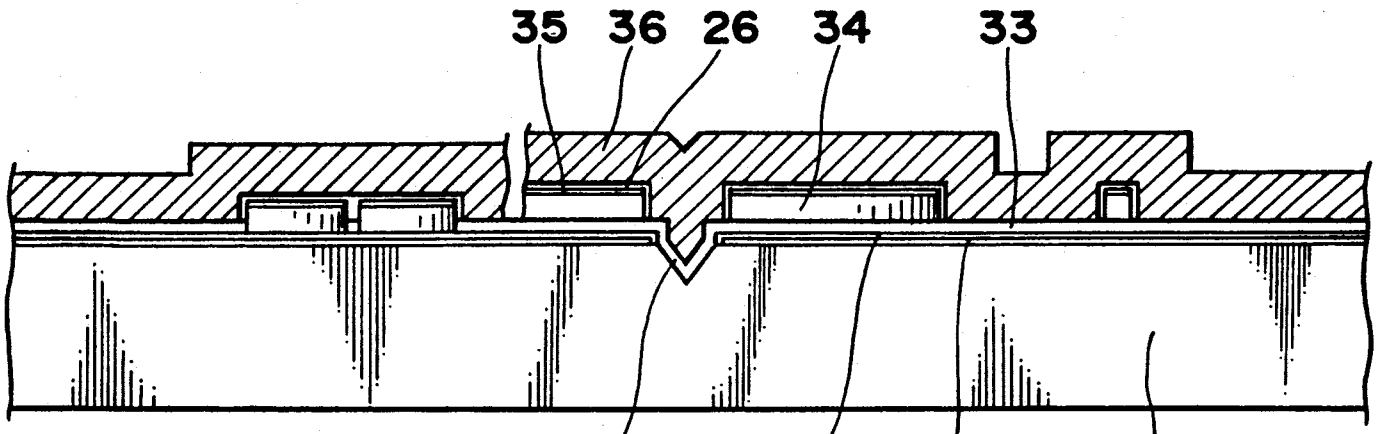
Figure 8J:
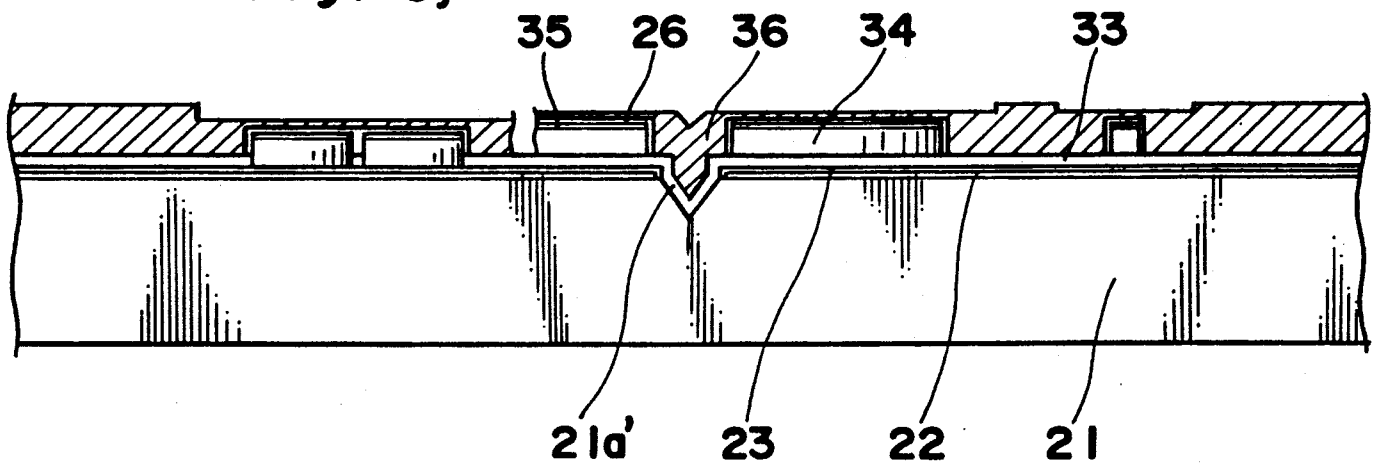
Figure 8K:
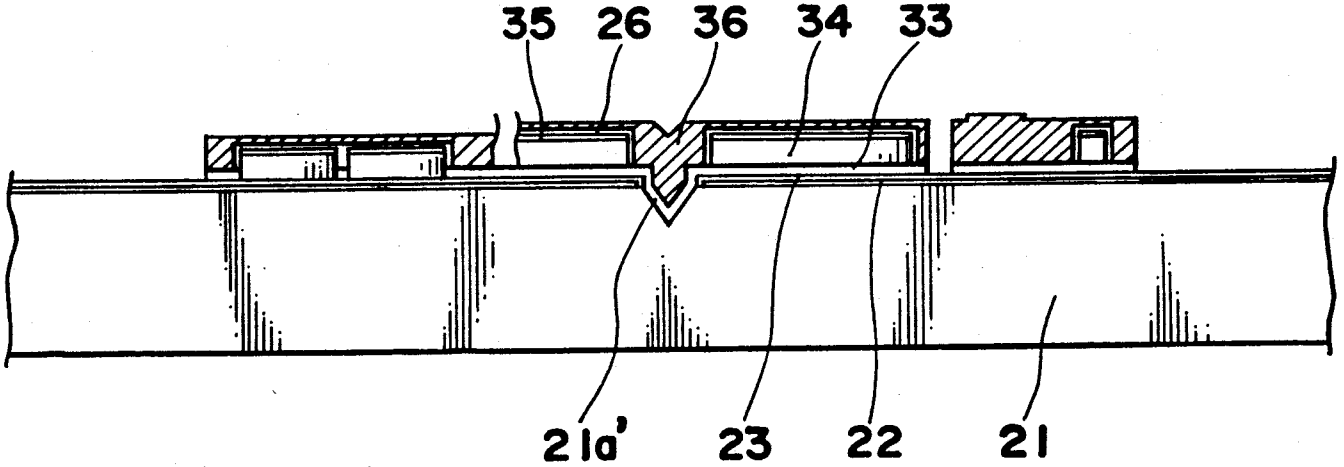
Figure 8L:
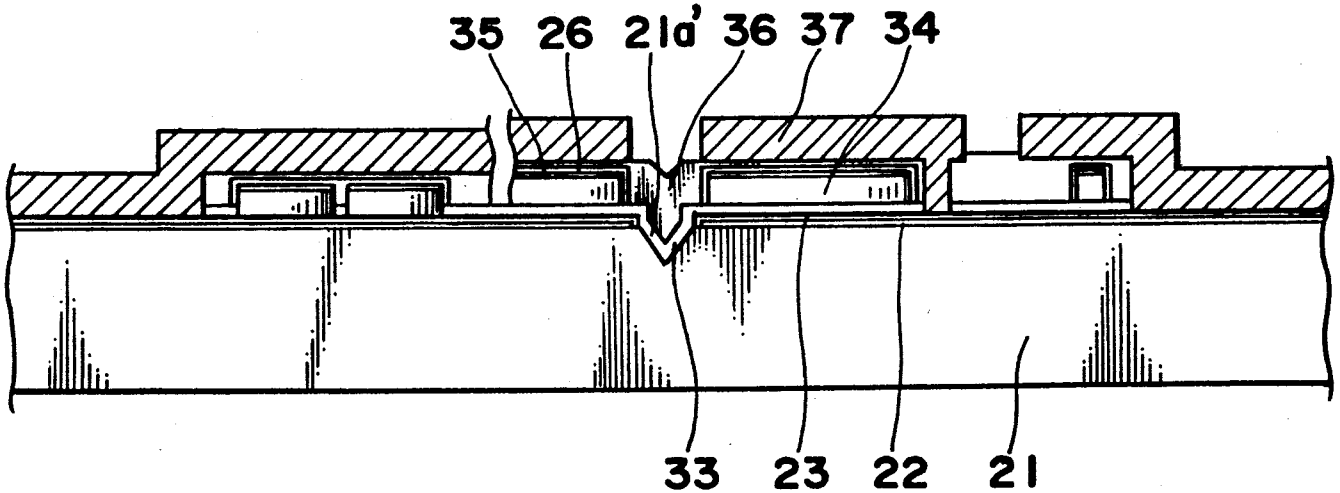
Figure 8M:
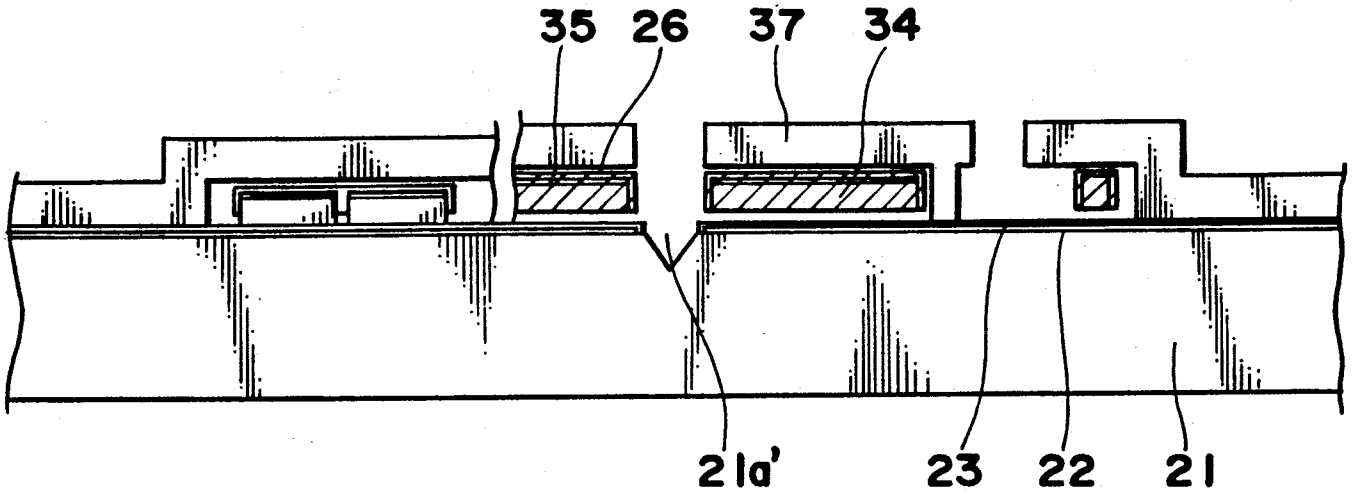
Figure 8N:
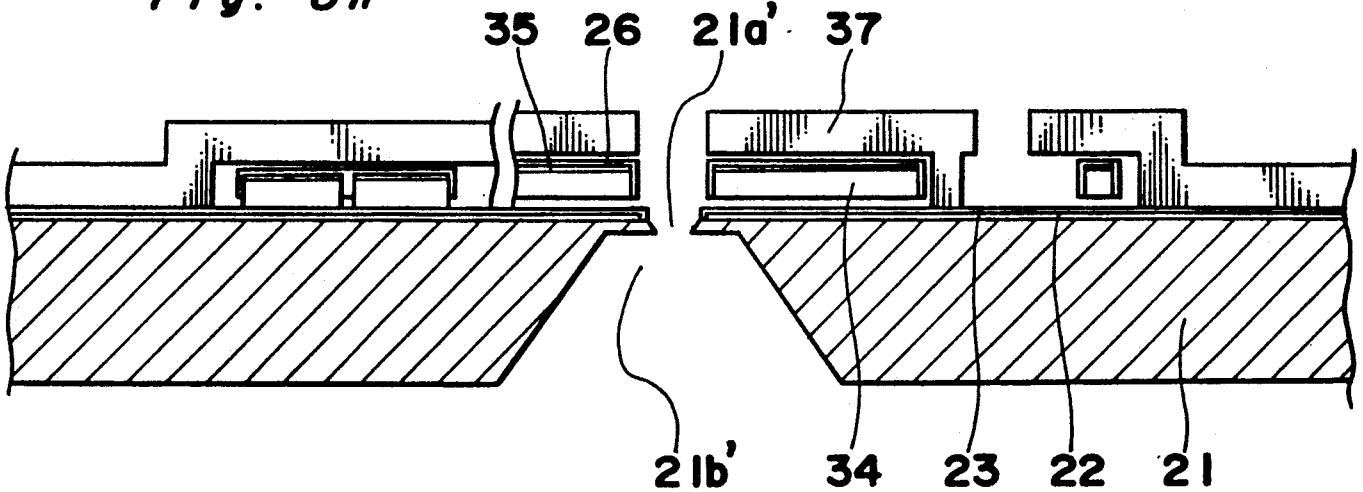

Next, with reference to FIGS. 8a to 8n, the ink recording apparatus of the above-mentioned method, wherein since the method utilizes the one generally used in semiconductor device manufacturing techniques, the description of individual processes will be simplified by omitting the details of common knowledge thereof.

(a) A concave portion 21a' is illustrated in FIG. 8a is formed on the surface of the single-crystal silicon substrate 21 by anisotropic etching. As the etching solution, an aqueous solution of potassium hydroxide (KOH) is used. Photoresist is removed by photo-resist stripping using oxygen plasma. The removal of photoresist is likewise carried out in the following processes.

(b) The oxide film 22 ($SiO_2$) is made to grow on the substrate 21. The oxide film 22 is grown by depositing a PSG (Phosphor Silicate Glass) layer 33 of a weight ratio of 8% by the method of LPCVD (Low Pressure Chemical Vapor Deposition) at a temperature of approximately 450° C., and the film 22 is etched using a buffered hydrofluoric acid, as shown in FIG. 8*b*.

(c) The nitride film 23 ($Si_3N_4$) is deposited on the oxide film 22 and subjected to patterning by RIE (reactive-ion-etching). The nitride film 23 in combination with the oxide film 22 makes up an insulating layer the dielectric breakdown voltage of which is more than 500 V. The nitride film 23 also serves to protect the oxide film 22 dissolved with the buffered hydrofluoric acid.

(d) A PSG layer 33 of a weight ratio of 8% is deposited by the LPCVD method at approximately 450° C., followed by etching using the buffered hydrofluoric acid.

(e) A polycrystalline-silicon layer 34 is entirely deposited at approximately 610 to 630° C. by the LPCVD method and shaped as shown in the figures by plasma etching. The polycrystalline-silicon layer 34 forms the electrodes 24*a* to 24*h* and the shutter 25. Then, annealing is performed to remove the residual stress. In addition, the polycrystalline-silicon layer 34 may be imparted with electrical conductivity by diffusing phosphorus therewith as required.

(f) An oxide film 35 is made to grow on the polycrystalline-silicon layer 34, where for the oxide film 35 a PSG layer of a weight ratio of 8% my be deposited at approximately 450° C. by the LPCVD method. The oxide film 35 will serve as a protection film for the RIE layer performed.

(g) The polycrystalline-silicon layer 34 and the oxide film 35 are subjected to patterning by plasma etching as shown in FIG. 8*g*, thereby shaping into the electrodes 24*a* to 24*h* and the shutter 25. In this process, end points are detected with 30% over etching, and annealing is performed to remove the residual stress.

(h) A nitride ($Si_3N_4$) film 26 is deposited as shown in FIG. 8*h*, where patterning is performed by the RIE. The nitride film 26 finally forms the above-mentioned nitride film (not shown), serving as a lubricating layer for reducing the friction between the shutter 25 and relevant portions and compensating for the brittleness of materials, and also serves as an insulating layer (not shown) for the electrodes 24*a* to 24*h*.

(i) A PSG layer 36 of a weight ratio of 8% is entirely deposited by the LPCVD method at approximately 450° C.

(j) The PSG layer 36 is etched using buffered hydrofluoric acid as shown in FIG. 8*j*.

(k) The PSG layer 36 is subjected to patterning by plasma etching as shown in FIG. 8*k*. This patterning will enable the fixing of the guide pins 27*b* and 27*c* and the front wall 28 (both shown in FIG. 1) to be later formed. The end points are detected with 30% overetching.

(l) A polycrystalline-silicon layer 37*n* is deposited by the LPCVD method at approximately 610° to 630° C. and subjected to patterning by plasma etching as shown in FIG. 81, thus forming the guide pins 27*b*, 27*c* and the front wall 28. Here, annealing is performed to remove the residual stress.

(m) The PSG layers (or oxide films) 33 and 36 are dissolved with a buffered hydrofluoric acid to form a movable member into which the polycrystalline-silicon layer 34 and the oxide film 35 are integrated, thereby forming the shutter 25 as shown in FIG. 1.

(n) The substrate 21 is anisotropically etched from its rear side as shown in FIG. 8*n* to form the concave portion 21*b'* until it is bored through up to the concave portion 21*a'* first formed. This allows the ink jet port 21*a* and the ink sump 21*b*, as shown in FIG. 2, to be formed.

Through the above processes, the ink recording apparatus of the first embodiment of the present invention can be manufactured. As seen here, the component structures are integrally manufactured using the semiconductor device manufacturing processes, thereby allowing the integrated head to be manufactured very simply and furthermore rendering them high in precision as well as steady in performance. Besides, the integration degree can be substantially increased by arranging the apparatuses crosswise. Accordingly, the ink recording apparatus can be steadily mass-produced which features their remarkably high reliability, light weight and compactness, low cost, quietness, high speed and high-density recording, and further high precision.

In addition, although in the foregoing first embodiment of the invention the one ink chamber 20 is illustrated with one ink jet port 21*a* formed thereon, the ink jet head is actually formed by integrating the apparatuses in high density, so the ink chamber may have generally a plurality of ink jet ports and shutters.

Figure 9:
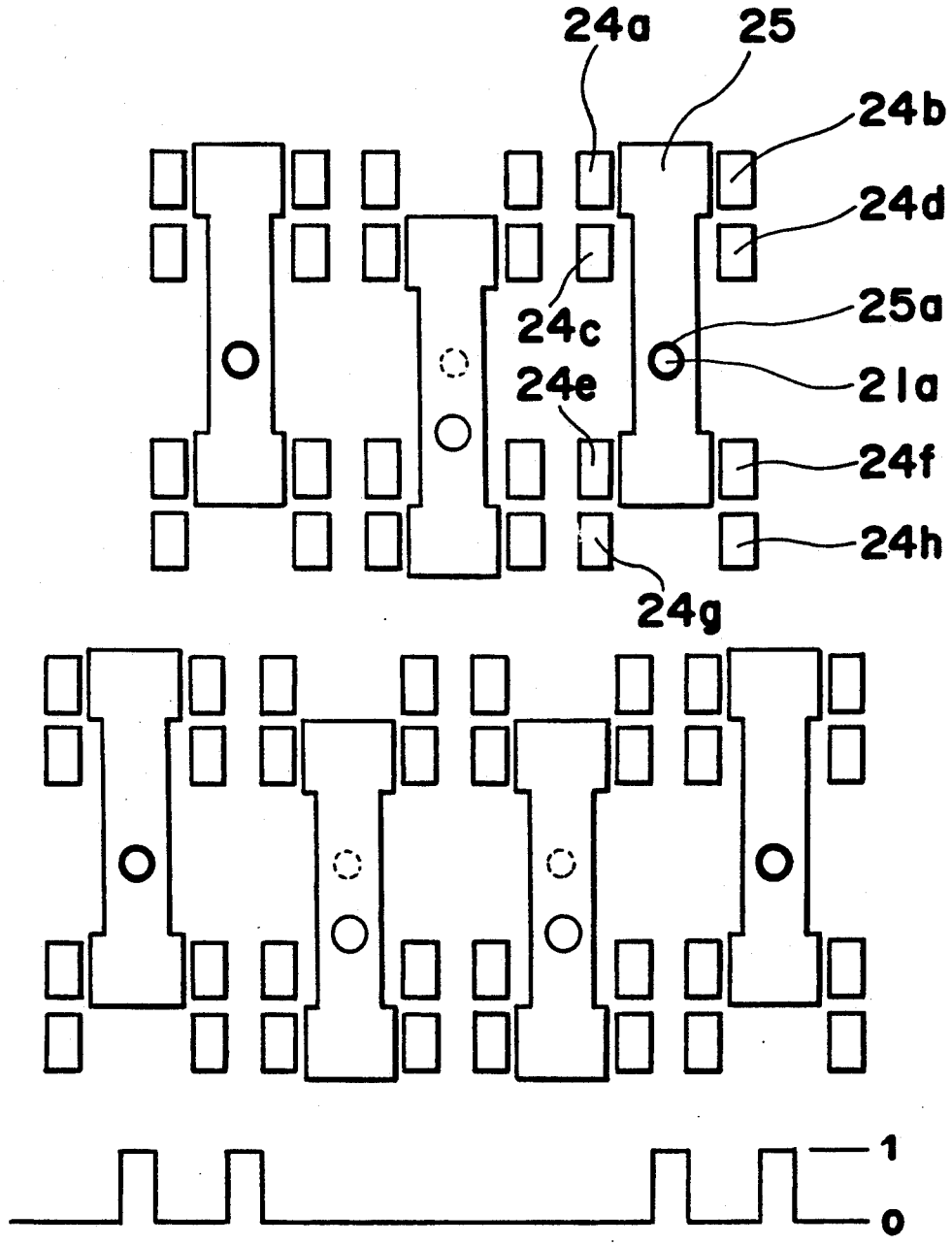
FIG. 9 is a plan view showing a pattern in which the ink recoding apparatuses of FIG. 1 are integrated.

An example of the ink jet head in which seven shutters 25 each having an ink jet port 21*a* are integrated in a staggered arrangement with one ink chamber (not shown) is shown in FIG. 9. The electrodes 24*a* to 24*h* are also arranged corresponding to each shutter 25. Though the other components are not illustrated, one pressure-applying unit and one pump are provided with the head corresponding to the one ink chamber. With respect to the front wall, a plurality of walls may be formed corresponding to either each shutter or some shutters. Otherwise, one front wall may be formed corresponding to all shutters. As shown at the bottom of FIG. 9, the condition of the shutter in recording is indicated by a signal "1", and the condition of the shutter in non-recording is indicated by a signal "0". When each shutter 25 is controlled by the signals, a pattern of characters, symbols, and any desired pictures are able to form on a sheet of recording paper. In this case control circuits are required corresponding to each of the shutter 25, but such integration of circuits is very easy and does not become a burden.

It is possible for the ink recording apparatuses of the first embodiment to be made into an integrated ink jet head as described above for even the full size of A4. Further, the arrangement density of them can be highly enough enhanced by arranging them in a staggered pattern.

For example, to maintain the required recording quality at 20 lines/mm of recording density, the diameter of the ink droplet ought to be 50 μm. According to the present invention, the size of ink droplet can be substantially freely set and such diameter is easily set. Then, the printer which employs the ink jet head described above is decidedly superior in high-speed recording performance thereof to the printer according to the prior art.

When the feeding direction of recording paper is set to be along the width of size A4 so that the size A3 is useable, the ink jet head is required to have a length of about 300 mm. Then, the head needs about 6000 (=20=300) units of the ink recording apparatus of the first embodiment. When the ink jet head takes a second to record an image of size A4 under such condition that the longitudinal recording density is equal to the lateral one, each dot must be recorded within 250 micro seconds. That is, the frequency of the shutter 25 is 4 KHz. Such frequency, however, is enough attained even by heating elements, the heating elements have various problems as described before. While, if a serial recording head included 80 ink jet heads recorded same amount of dots within a same period, traversing the recording paper along longitudinal direction of size A4, it should take 3.3 micro seconds to record a dot even if the reversing time of the head were 0 second. The frequency of a pressure-creating means of the ink jet head corresponding to such recording speed of the serial recording head is just attained by piezoelectric elements. But the piezoelectric elements have various problems described before, and are not useable for the serial recording head. It means that the ink recording apparatus according to the present invention has a very high potential.

The second embodiment of the invention can be arranged as shown in FIGS. 10 to 13, wherein a single-crystal silicon substrate 41 has an ink jet port 41*a* provided in the center thereof and an ink sump 41*b* provided on its side adjoining an ink chamber 40. The ink jet port 41*a* is formed as bored from the ink sump 41*b* through an oxide film 42 and a nitride film 43. Electrodes 44*a* to 44*e* formed of polycrystalline-silicon, the wiring of the which is omitted in the figures, each have on their surfaces a nitride film formed as an insulating layer (not shown). A shutter 45 formed of polycrystalline-silicon has an ink passing hole 45*a* provided in the center thereof. On the surfaces of the shutter 45, except for the underside thereof, there are formed nitride films (not shown) as lubricating layers. Shaft 47 is also formed of polycrystalline-silicon, supports the shutter 45 rotatably and also holds the shutter 45 by an upper flanged portion 47*a* thereof. The ink chamber 40 and the ink sump 41*b* are charged with ink 51 composed of insulating material.

The component shown in FIGS. 10 to 13, like the first embodiment, are integrally manufactured onto the substrate 41 using semiconductor device manufacturing processes including lithography and etching. The result, also like the first embodiment, its that the component parts are substantially compact in size, light in weight,k and of high precision, comparable to semiconductor products. Therefore, an ink jet head in which the ink recording apparatuses of the present embodiment are integrated is manufactured without difficulty, and it is possible to select the arrangement pattern of the apparatus and/or their arrangement density in integration.

The control circuit for the shutter 45 and the pressure-applying unit for the ink 51 are the same as the first embodiment.

Figure 11:
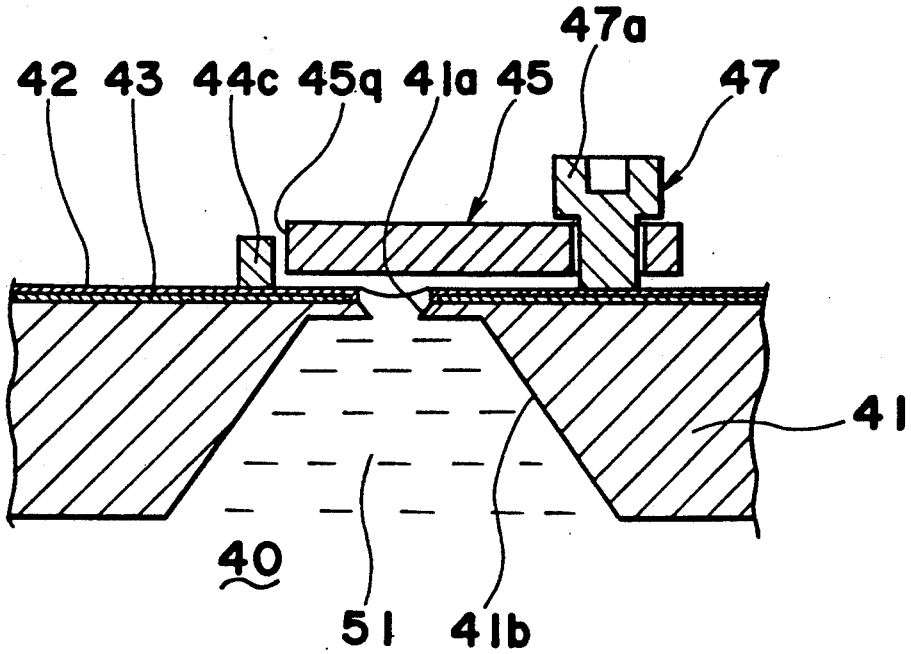
FIG. 11 is a sectional view taken along line XI—XI of FIG. 10.

Now the ink recording apparatus arranged as stated above will be explained with respect to its operation. The state thereof shown in FIGS. 10 and 11 is such that a voltage of several times 10 V or so is applied to the electrodes 44*a* and 44*c*. In this state, the shutter 45 is stably positioned as shown in the figures with its ends 45*p* and 45*q* held by virtue of electrostatic attracting force acting between the ends and the surfaces of the electrodes 44*a* and 44*c*, where the ink jet port 41*a* of the substrate 41 is shut off by the shutter 45, so that the ink 51 charged in the ink sump 41*b* can not be jetted out through the ink passing hole 45*a* even if the ink is jetted through the ink jet port 41*a* due to the pressure applied to the ink. At this point in the state of the apparatus, even if a sheet of recording paper is set at the outside of the shutter 45, the shutter 25 does not allow the ink droplets to record any patterns of characters, symbols, and the like.

Figure 12:
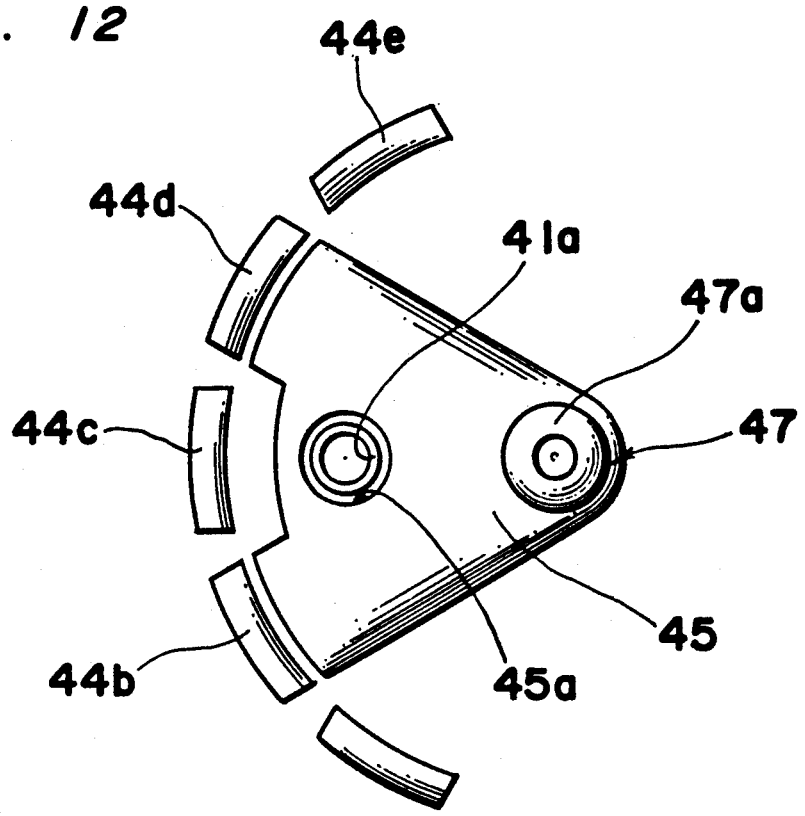
FIGS. 12 and 13 are views illustrating the operation of the ink recording apparatus of FIG. 10.

Next, the ink recording apparatus will be described in its states in which the shutter 45 has moved away from the position shown in FIG. 10. In this case, the control circuit judges that the apparatus will complete an ink-jetting operation according to an input signal delivered from the apparatus main body via the input terminal, changing the condition of the switches, with a result such that the applied voltage is changed from the electrodes 44*a* and 44*c* to the electrodes 44*b* and 44*d*. In this case, as shown in FIG. 12, the shutter 45 is stably positioned in rest after having rotated about the shaft 47 in a clockwise direction from the position shown in FIG. 10, with its ends 45*p* and 45*q* held by virtue of the electrostatic attracting force acting between the ends and the surfaces of the electrodes 44*d* and 44*d*, wherein the ink passing hole 45*a* of the shutter 45 is aligned with the ink chamber 40, the ink 51 charged in the ink sump 41*b* passes through the ink jet port 41*a* and the ink passing hole 45*a* of the shutter 25, thus causing ink droplets (not shown) to be jetted out.

At this point in the state of the apparatus, setting recording paper at the outside of the shutter 45 allows the ink droplets to record any patterns of characters, symbols, and the like.

Figure 13:
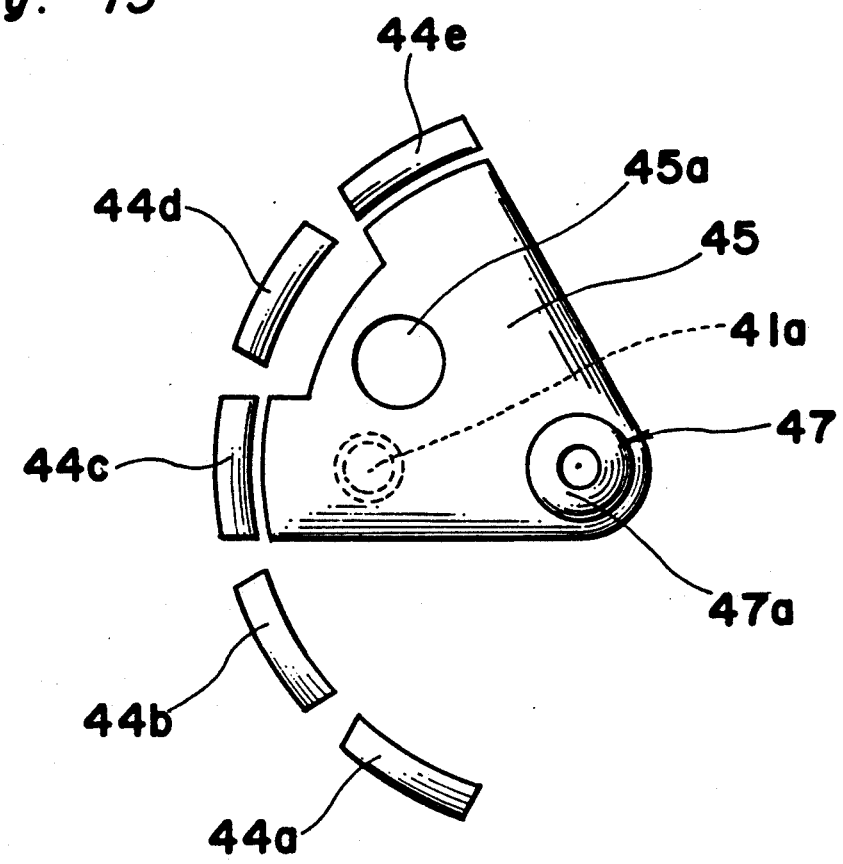
Figure 14:
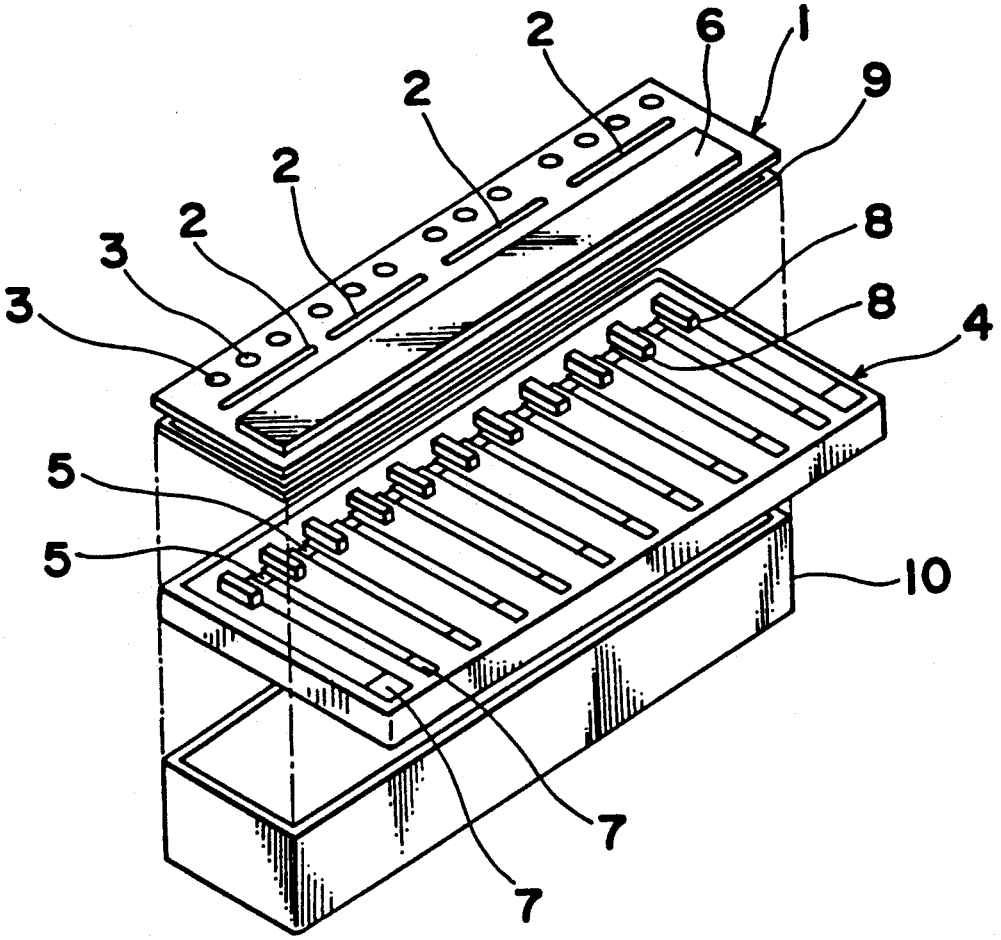
Fig. 14 PRIOR ART
FIG. 14 is a perspective view showing the construction of an ink recording apparatus according to the prior art.
Figure 15A:
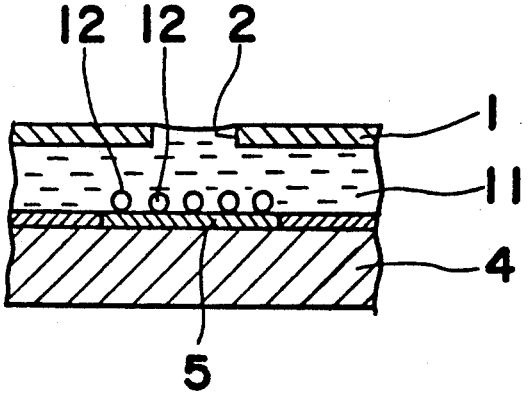
Fig. 15a PRIOR ART
FIGS. 15*a* to 15*d* are views illustrating the operation of the apparatus of FIG. 14.
Figure 15B:
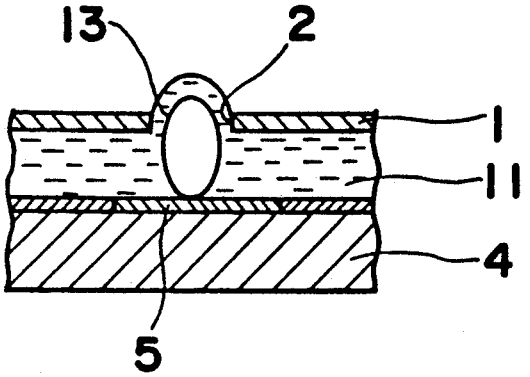
Fig. 15b PRIOR ART
Figure 15C:
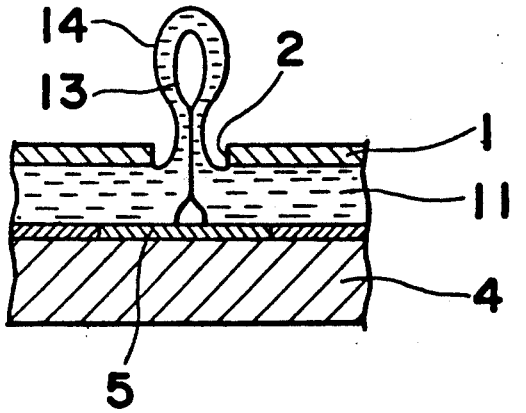
Fig. 15c PRIOR ART
Figure 15D:
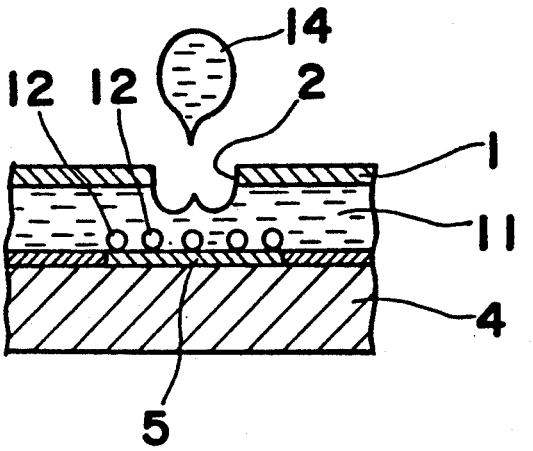
Fig. 15d PRIOR ART

After the above the applied voltage is changed again, from the electrodes 44*b* and 44*d* to the electrodes 44*c* and 44*e*. In this case, as shown in FIG. 13, the shutter 45 isstably positioned in rest after having rotated about the shaft 47 in a clockwise direction from the position shown in FIG. 12, with its ends 45*p* and 45*q* held by virtue of the electrostatic attracting force acting between the ends and the surfaces of the electrodes 44*c* and 44*e*, wherein the shutter 45 again shuts the ink jet port 41*a*. At this point in the state of the apparatus, the shutter 25 does not allow the ink droplets to record any patterns of characters, symbols, and the like.

Since the second embodiment is the same as the variation of the first embodiment having three rest positions of the shutter in operation, the second embodiment can perform the area gradation recording, too.

As described heretofore, according to the second embodiment of the present invention, as in the first embodiment, it is possible to provide an ink recording apparatus which can control the jetting and shutting of the ink droplets under the mechanical control of the shutter 45, which is rotated by applying voltage to the electrodes 44*a* to 44*e*, and which can be highly reliable and superior in recording quality. Further, the second embodiment may be faster than the first embodiment in the recording speed, and can be modified for an ink recording apparatus which needs neither heating elements nor piezoelectric elements in the ink chamber (expecting means for applying pressure to the whole of the ink chamber) when the shutter 45 is driven in response to recording signals.

In addition, with respect to the second embodiment, the front wall and the protection plate are not mentioned in the explanation thereof, but these elements can be easily formed as necessary. In the first and second embodiments, the electrostatic attracting force is, however, used as the driving force for the shutter, but other means of course may be used. Further, the shape of the ink jet port is not required to be a circle. For example, the ink jet port may be a slit which cooperates with the ink passing hole in forming the ink droplets.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. An ink recording apparatus, comprising:
an ink chamber for holding ink therein;
an ink jet port provided in said ink chamber;
pressure means for applying pressure to ink in said ink chamber;
a shutter having an outer surface disposed at said ink jet port, said shutter comprising a thin film disposed so as to be moveable between a shut-off position for preventing ink from being jetted out after passing through said ink jet port and a passing position for allowing ink to be jetted out after passing through said ink jet port; and
shutter driving means for driving said shutter between said shut-off and passing positions in response to recording signals, said shutter driving means comprising electrodes having surfaces provided in correspondence with said shut-off position and said passing position of said shutter, a power supply for applying a voltage to said electrodes and a control circuit for controlling the voltage applied to said electrodes by said power supply, whereby said shutter is driven by electrostatic attraction forces between the surfaces of said electrodes and the surface of said shutter.

2. The ink recording apparatus of claim 1, wherein a plurality of respective said shutters are provided corresponding to one said ink chamber.

3. The ink recording apparatus of claim 1, wherein said pressure means comprises a first control means for controlling timing of an application of pressure to the ink in said ink chamber in synchronization with movement of said shutter by said shutter driving means.

4. The ink recording apparatus of claim 3, wherein said pressure means includes a piezoelectric element.

5. The ink recording apparatus of claim 1, and further comprising ink recovery means for recovering ink shut off by said shutter and returning the ink to said ink chamber.

6. The ink recording apparatus of claim 1, wherein said control circuit of said shutter driving means has means for controlling a period of time said shutter is at said passing position and said shut-off position.

7. An ink recording apparatus, comprising:
an ink chamber for holding ink therein;
an ink jet port provided in said ink chamber;
pressure means for applying pressure to ink in said ink chamber;
a shutter having an outer surface disposed at said ink jet port outside of said ink chamber, said shutter comprising a thin film disposed so as to be moveable between a shut-off position for preventing ink from being jetted out after passing through said ink jet ports and a passing position for allowing ink to be jetted out after passing through said ink jet port;
shutter driving means for driving said shutter between said shut-off and passing positions in response to recording signals, said shutter driving means comprising electrodes having surfaces provided in correspondence with said shut-off position and said passing position of said shutter, a power supply for applying a voltage to said electrodes and a control circuit for controlling the voltage applied to said electrodes by said power supply, whereby said shutter is driven by electrostatic attraction forces between the surfaces of said electrodes and the surface of said shutter; and
a wall disposed outside of said shutter relative to said ink chamber for covering the external surface of said shutter.

8. The ink recording apparatus of claim 7, wherein a plurality of respective said shutters are provided corresponding to one said ink chamber.

9. The ink recording apparatus of claim 7, wherein said pressure means comprises a first control means for controlling timing of an application of pressure to the ink in said ink chamber in synchronization with movement of said shutter by said shutter driving means.

10. The ink recording apparatus of claim 7, wherein said pressure means includes a piezoelectric element.

11. The ink recording apparatus of claim 7, and further comprising ink recovery means for recovering ink shut off by said shutter and returning the ink to said ink chamber.

12. The ink recording apparatus of claim 7, wherein said control circuit of said shutter driving means has means for controlling a period of time said shutter is at said passing position and said shut-off position.

* * * * *